United States Patent [19]

Quatrino

[11] Patent Number: 4,826,175

[45] Date of Patent: May 2, 1989

[54] WORD CARD GAME

[76] Inventor: Janet W. Quatrino, R.D. #2, Box 38A, Little Falls, N.Y. 13365

[21] Appl. No.: 50,695

[22] Filed: May 18, 1987

[51] Int. Cl.[4] ..... A63F 1/00

[52] U.S. Cl. ..... 273/299

[58] Field of Search ..... 273/272, 299

[56] References Cited

U.S. PATENT DOCUMENTS

| | | | |
|---|---|---|---|
| D. 171,084 | 12/1953 | Corbett et al. | 273/299 X |
| 1,012,574 | 12/1911 | Adams | 273/299 |
| 1,377,327 | 5/1921 | Ebert | 273/299 |
| 2,265,334 | 12/1938 | Armbruster | 273/299 |
| 2,783,998 | 9/1954 | Collins | 273/299 |
| 4,192,513 | 3/1980 | Feeley | 273/299 X |
| 4,333,656 | 6/1982 | Sommer | 273/299 |

FOREIGN PATENT DOCUMENTS

| | | | |
|---|---|---|---|
| 449879 | 7/1936 | United Kingdom | 273/299 |
| 2137513 | 10/1984 | United Kingdom | 273/299 |

*Primary Examiner*—Anton O. Oechsle

*Attorney, Agent, or Firm*—Schmeiser, Morelle & Watts

[57] ABSTRACT

A card word game wherein each card has a numerical and alphabetical designation. In addition each card contains identifying indicia which places the card in one of at least three card groups. Each player takes turns creating words said words may only be created from letters contained within the same card group. In addition to creating new words each player during his turn may place letters from his hand on top of letters from the same group which have already been used to create words so as to form new words and receive the point values indicated on all the letters comprising said word. At the end of each players turn that player discards one playing card. The discarded card being placed upon discard pile designated for that card group. Each player at the beginning of his turn having the option of choosing a card from the draw pile or to take all the cards in any one discard pile.

4 Claims, 1 Drawing Sheet

WORD CARD GAME

FIELD OF THE INVENTION

Generally this invention relates to word games and more specifically it relates to cards which may be used in a game to create words.

BACKGROUND OF THE INVENTION

Word games come in a variety of forms including those which use cubes with letters thereon or tiles or cards. Generally it is the purpose of these games to both provide entertainment and be challenging. In addition, where the games may be used by children they may have a very positive effect helping the child learn to spell.

Most of these games simply provide each player with a certain number of letters and then in turn each player uses those letters to form words. In some games the player will draw from a draw pile or letter bank, the same number of letters which were used to create the word. Generally, each letter will have a number associated with it which points are totaled so that the players may compete.

Some games discovered in the prior art combine letters with regular cards, distinguishing the deck of cards into groups made of hearts, diamonds, clubs and spades. Generally the purpose of this is to allow the same deck of cards to be used when playing a large variety of game. I have found that most of the strategy required in these games is primarily and sometimes only based on the players ability to create words from the letters provided with only slight strategy being required with regard to the placement of the letters or their arrangement.

Because of the limited strategies required, players, and especially younger players, tend to loose interest in such games very quickly. Thus, they also loose the related benefit received from playing such word games.

Accordingly it is an object of this invention to provide a card word game which includes a variety of strategic decisions;

Another object of this invention is to provide a card word game which is easy to use and may be played by individuals of various ages and at different levels of expertise;

Yet another object of this invention is to provide a card word game which is easy to use and may be played without the need for a large number of parts or game boards;

Still another object of this invention is to provide a card word game which is easy and inexpensive to manufacture.

Other objects and advantages of this game may be realized by study of the subject specification as well as by actually playing the said game. Similarly, variations may be made from the present disclosure which are within the spirit of this invention, said invention intended only to be limited by the appended claim.

SUMMARY OF THE INVENTION

It has been found that the objects of this invention may be accomplished by providing a deck of cards having indicia thereon which may be used to separate the cards into at least three distinct groups. Each group of cards contains all of the letters in the alphabet plus additional selected letters which are more frequently used and therefore necessary to create a variety of words. Each letter is given a point value which points may be totaled in order to measure one's success. Of particular importance is the fact that words may only be created from letters contained within the same group. Similarly, on any given turn a player may place new letters on top of an already formed word thereby substituting said new letter for the one already played, but again the replacement letters must be from the same group as the card which it is replacing.

On each turn a player may create more than one word. This results in additional strategic decisions since play ends when one player has played all his cards or when there are no more cards left in the draw pile. When a round ends, players with cards remaining in their hand total the point value of said cards and subtract that point value from their prior total from previous rounds. Therefore, a player may accumulate letters within his hand with the hope of playing all his letters at the same time thereby surprising his opponents and leaving them with a significant number of cards in their hand to be subtracted from their previous total.

DESCRIPTION OF THE PREFERRED EMBODIMENT

Figure 1:
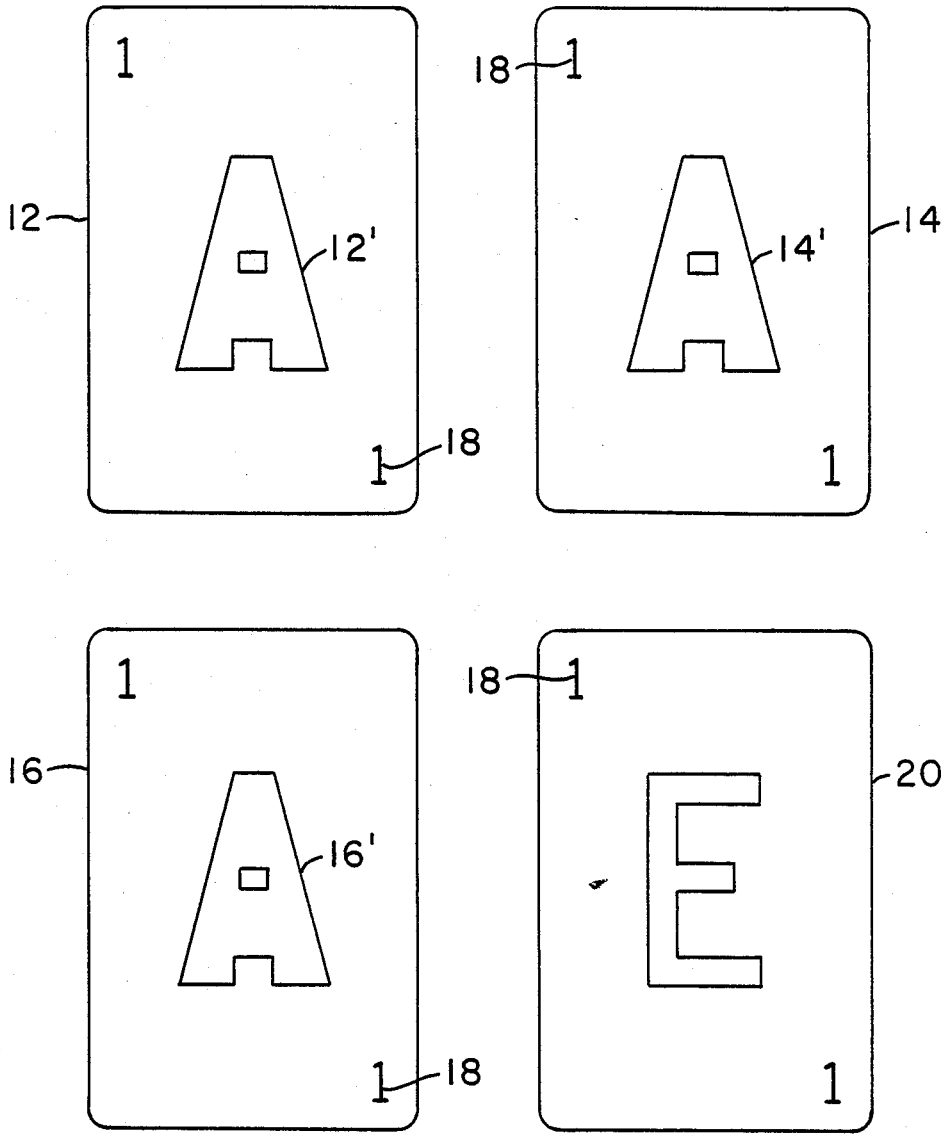
FIG. 1 is a top view of four of the playing cards used in the subject invention.

FIG. 1 shows four typical playing cards generally designated as 10. Cards 12, 14 and 16 all contain the letter A and are identical with regard to their alphabetic as well numerical designation. However, the letters in the deck will have indicia which will separate them into different groups. In my preferred embodiment there are three groups and the distinguishing indicia would be the letter color. For example, 12 would be red, 14 green and 16 blue. Each card has a numerical designation 18 placed in opposing corners. The side of the cards shown in FIG. 1 is the face side and it is intended that the back of the cards would all be identical and of any preferred design.

As shown in FIG. 1 cards 12, 14 and 16 have a numerical designation of "1". Similarly, card 20 which discloses the letter "E" also has a numerical designation of 1. Nevertheless, in my preferred embodiment the points for the letters range from 1–4. Letters having a value of one point would include the letters A, B, D, E, H, I, L, M, N, 0, P, R, S, T and U; letters with the value of two points would include the letters C, F, G, J, K, V, W and Y; letters having a value of three points would be the letters X and Z; and the letter having a value of four points would be the letter combination QU.

In my preferred embodiment each color group contains 43 cards in the following quantities: A-4, B-1, C-1, D-2, E-5, F-1, G-1, H-1, I-4, J-1, L-1, M-1, N-2, 0-2, P-1, QU-1, R-2, S-2, T-2, U-2, V-1, W-1, X-1, Y-1, Z-1. Those letters appearing more than once in each color group are those letters which are most frequently used in the English Language when creating words.

The play of the game begins by choosing a certain score, the first player to reaching that score at the end of round being the winner. For the purposes of this disclosure a round will be considered to begin when each player is dealt a hand of cards and when either one player has played all of his cards or when there are no remaining draw cards. The game consists of a series of rounds which result in the totaling of points toward the predetermined winning point value. In an alternate embodiment it is possible to simply play a one round game where there is no predetermined number that needs to be reached, and the winner is simply the person with the most points at the end of that round.

Once these determinations have been made each player is dealt 12 cards which starts the first round. The cards remaining are placed in a draw pile. The top card from the draw pile is turned over thus starting the first discard pile. The player to the left of the dealer starts by either selecting a card from the draw pile or taking the card from the discard pile. Since going first may be advantageous, the dealer may be selected by cutting the deck, the player with the highest numerical designation being the dealer. After selecting a card the player may create a word and place that word in front of him. The player whose turn it is, is not limited to making one word but may continue to create words as long as he is able. This aspect of the game takes the emphasis off of trying to create one large word and instead helps the player appreciate the interaction between various letters so that the maximum number of words and letters may be used. However, each word can only consist of cards within the same color group. When a word is created the numerical values on the cards used to create the word are totaled and that player is credited with that amount. After the turn the player, assuming he has cards left in his hand, places a card either on the discard pile which was initially created if his discarded card is of the same group, or else he starts a new discard pile if his discard letter is of a different group.

Play continues with the player to the left of the person who has completed his turn. The second player goes through the same steps as the previous player and play continues in the same fashion except for two significant variations.

When a player taking his turn has previously created words which he has laid down that player may cover some of the letters used to create such word with letters of the same group in order to create a new word. The creation of new words may enlarge the first word but no words may be used which intercept a created Word horizontally. In my preferred embodiment a player may only substitute letters for those words Which he has already created. However, it is anticipated that one variation of the game could include the players being able to substitute letters for letters of the same color group in words created by any of the other players. When any letter substitution has been made the total numerical value of all the cards which create the new word are totaled and that value credited to the player making the substitutions. Although not necessary, in my preferred embodiment, it is also preferred that only one substitution for each letter in a word be allowed.

Secondly, When a player decides to choose from a discard pile he must take all the cards in the discard pile. Any player on his turn may decide to pick up any one of the three discard piles, one for each group, and is not required to use any of those cards to make a Word at that time.

When any player at the end of his turn has no cards remaining either because they have all been used to create words or becausé all but one card has been used to create a word and that single remaining card discarded, the round ends. Players With cards remaining in their hand total the numerical value of those cards and subtract that Value from their previous acquired totals. Should no player be able to play all of his cards, the round ends when the last card is taken from the draw pile. In my preferred embodiment the player selecting the last card from the draw pile has the opportunity to make his final words. It may be possible however, if desired to allow each player one turn to make all the words he possibly can after the draw pile is depleted.

In my preferred embodiment the words created may not be proper names, foreign words, abbreviations, contractions or hyphenated words. After each round the deal rotates clock wise to the next player, the game continuing until the predetermined number of points is obtained at the end of a round. Should more than one player obtain the predetermined total by the end of a round, the player with the highest number is the winner. If a word is created which is comprised of six or more letters the player receives two times the total point value as indicated on the cards. Also, each word created must be comprised of at least three letters.

Should there be a difference between the ability of the players, as may exist when a parent and child are playing, the parameters for the length of a required word and for doubling the point value may be varied. For example, the older or more adept player may be required to make words that contain at least four letter and only receive a double score for words of seven letters or more. Conversely, the less experienced or younger player may be allowed to create words of two letters and receive a double score for words with four letters or more.

Should a player create a word, the spelling of which is in question, any other player may object to the word the spelling of which is then checked. If the spelling is correct the player that created the word receives the appropriate points while the player who objected has that same number of points subtracted from his total. Conversely, if the word is spelled incorrectly the player creating the word looses the total number of points in the word from his total and the player objecting successfully has the word point value added to his score.

It should be appreciated that numerous variations may be made which are in harmony with the intent and disclosure o the subject invention. Accordingly, the preferred embodiment has been herein disclosed along with several possible alterations. However, it is intended that the scope of this invention be limited only by the appended claims.

I claim:

1. A card word game comprising the following steps:
   - dealing each player a hand consisting of a predetermined number of playing cards, each card having on its face side a letter designation, each card having an identifying indicia which aligns the card with one of a least three card groups, each card also having a numerical point value on its face side;
   - placing the remaining un-dealt cards in a draw pile;
   - turning over one card from the draw pile to start a first discard pile;
   - moving from player to player each player taking a turn which further comprises the steps of:
   - selecting a card from the draw pile or the discard pile;
   - creating a word from cards in the player's hand having the same color;
   - creating additional words from the remaining cards in the player's hand having the same color;
   - laying the words out, each player receiving credit for the sum of the numerical values on the cards used to create the words;

discarding a card face up on the discard pile having cards of the same color or starting a new discard pile if there is no discard pile of the same color, if the player has any cards remaining; and continuing play until either one player has no cards remaining or all the cards in the draw pile are used.

2. The invention of claim 1 wherein a player drawing from the discard pile must take all the cards in the pile, said play further comprising the following steps;

totaling the points for each player at the end of each hand and adding said points to that players accumulated point total from all prior hands;

subtracting the total point value of the cards each player failed to play before the end of the hand from that Players accumulated total from prior hands; and continuing playing hands until a predetermined total is reached, the player with the highest total being the winner.

3. The invention of claim 1 where a player may, during his turn, over-lay letters already used to create a word in order to create a new word and receive credit therefor.

4. The invention of claim 3 wherein the player may only overlay letters with letters from the same card group.

* * * * *